United States Patent [19]

Mizushima et al.

[11] 4,141,207

[45] Feb. 27, 1979

[54] PROCESS FOR PRODUCING CURL SHRUNK SILK YARN

[76] Inventors: Shigesaburo Mizushima, No. 98-11, Notobeshimo, Rokusei-machi; Hiroshi Kosugi, No. 26, Kuritaya, Kanagawa-ku, both of Japan

[21] Appl. No.: 830,317

[22] Filed: Sep. 2, 1977

[51] Int. Cl.[2] ..... D02G 1/00

[52] U.S. Cl. ..... 57/243; 8/128 R; 57/247; 57/250; 57/292; 57/351

[58] Field of Search ..... 57/139, 153, 157 TS, 57/157 MS, 164; 28/217, 220; 8/128 R

[56] References Cited

FOREIGN PATENT DOCUMENTS 45-8733 3/1970 Japan ..... 57/157 TS 47-14043 4/1972 Japan ..... 57/164

*Primary Examiner*—Charles Gorenstein

*Attorney, Agent, or Firm*—Wenderoth, Lind & Ponack

[57] ABSTRACT

This invention relates to a process for producing a curl shrunk silk yarn. One of the features of the invention is to absorb collagen derived protein into raw silk material after sericin is removed therefrom. Thereafter, silk fibers are twisted in a S- or Z-direction and then saturated with moisture. Another feature of the invention is to maintain the moisture saturated silk fibers at prescribed temperature and under prescribed pressure for a given time. Thereafter, the fibers are untwisted in the reverse direction and given a curl shrinkage characteristic under the circumstance of saturated vapor.

2 Claims, 3 Drawing Figures

PROCESS FOR PRODUCING CURL SHRUNK SILK YARN

BACKGROUND OF THE INVENTION

It is known that silk filament fibers, like synthetic fibers, are not given permanent curl shrinkage only by twisting. There has been a proposal in which silk fibers are treated with hydrophobic resin to give it curl shrinkage whereby it is maintained at twisted condition even though it is subjected to heat (Japanese Patent Application Publication No. 16,853/1962.) However, since the silk fibers are covered with resin, the essential properties of silk fibers cannot be obtained. Also, the facilities are obliged to be large and the processes are disadvantageously complicated.

There is proposed a process for producing a curl shrink silk yarn in which silk fibers are scoured by a scouring agent including crude sodium sulfate ($Na_2SO4$ $10H_2O$). This has been disclosed in Japanese Patent Application Publication No. 14043/1972.) In that process, the crude sodium sulfate serves to prevent scouring, and therefore, when a soap together with the crude sodium sulfate scours the silk fibers, 10% of sericin remains on the silk fibers without removal. This causes the silk fibers to be given a curl shrinkage.

One of the disadvantages of the prior art is that the crude sodium sulfate included in the scouring agent causes the product to lack a uniformity in scouring. Another disadvantage of the prior art is that a predetermined amount of the remaining sericin cannot be maintained because the solubility of the sericin by alkali(soap or sodas) or the like is based on the season of rearing silkworms (spring, summer, autumn and late autumn) or on the breed of silkworms. Accordingly, a product of uniform curl shrinkage cannot be obtained. Another disadvantage of the prior art is to provide a luster and a texture to the scoured silk fibers due to the remaining sericin of the silk fibers. Further disadvantage of the prior art is in loss of the strength and durability of the silk fibers if they are treated at temperature of 148° to 153° C. and under pressure of 3.9 to 4.5 kg/cm$^2$ as disclosed in the Japanese Patent Application Publication No. 14043/1972, due to sensitivity to the heat and high pressure of the animal fibers.

SUMMARY OF THE INVENTION

Accordingly, it is a principle object of the invention to provide a process for producing a silk yarn of uniform curl shrinkage wherein the luster and texture the of silk can be provided to the yarn while the strength and the durability are improved.

It is another object of the invention to provide a curl shrunk silk yarn having such characteristics of luster and texture as fibroin of silk has.

In accordance with one aspect of the invention, there is provided a process for producing a curl shrunk silk yarn, comprising the steps of removing sericin from raw silk material; then absorbing collagen derived protein into said raw silk material; thereafter twisting the silk fibers in a S- or Z-direction; saturating said twisted silk fibers with moisture; maintaining said moisture saturated silk fibers at temperature of 130° to 140° C. and under a pressure of 3 to 3.5 atmospheres for 10 to 20 minutes; then untwisting said silk fibers in the reverse direction; and treating said silk fibers with saturated vapor whereby said silk fibers are given a uniform curl shrinkage.

In accordance with another aspect of the invention, there is provided a curl shrunk silk yarn comprising silk fibers of fibroin which absorbs collagen derived protein.

DETAILED DESCRIPTION OF THE INVENTION

As well known, silk is composed of fibroin and sericin. The fibroin is composed of more than sixteen kinds of amino acids, the principal components of which are more than 40% of hydrophobic glycine and more than 30% of hydrophobic alanine and occupy more than three-fourths of the fibroin. These kinds of amino acids are peptide-connected to each other so as to form a chain combination. Some portions of the fibroin at both the glycine and the alanine are arranged in a regular manner to each other, but other portions of the fibroin not only at both the glycine and the alanine but also at the other components are arranged in an irregular manner. The regular portions of the glycine and the alanine occupying three-fourths of the fibroin are called crystal portions because of their regular arrangement, while the irregular portions of the remaining amino acid are called non-crystal portions because of their irregular arrangement. One of the most important features of the invention is to treat the non-crystal portions of the fibroin with collagen derived protein, the collagen derived protein has the molecular structure of RCONH (R"CHCONHCHR''')n COOX wherein X may be organic amine, sodium, potassium, ammonium or the like, alcohol, or saturated or unsaturated fatty acid having R of $C_{12}$ to $C_{18}$. Raw silk material is treated with a solution of collagen derived protein so as to absorb the collagen derived protein into the fibroin. This causes the uncrystal portions of the fibroin to be stabilized while the silk fibers are twisted and treated under high pressure and at high temperature, whereby the silk fibers are given a permanent curl shrinkage because of its twisting stress.

Figure 1:
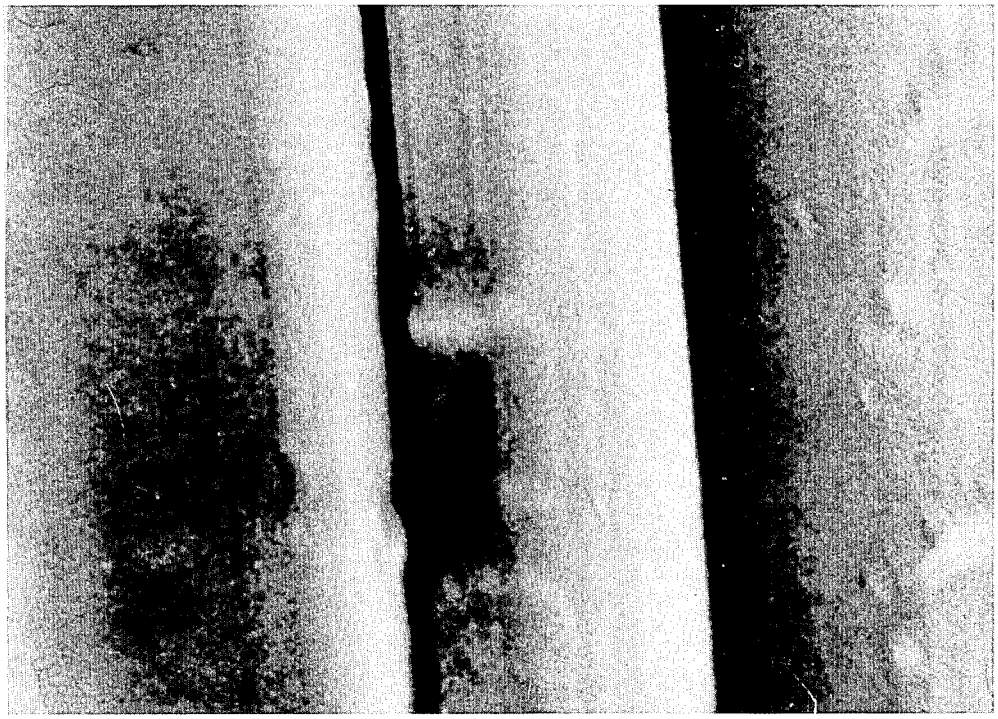
FIGS. 1 to 3 are photomicrographs of the curl shrunk yarn of the present invention.
Figure 2:
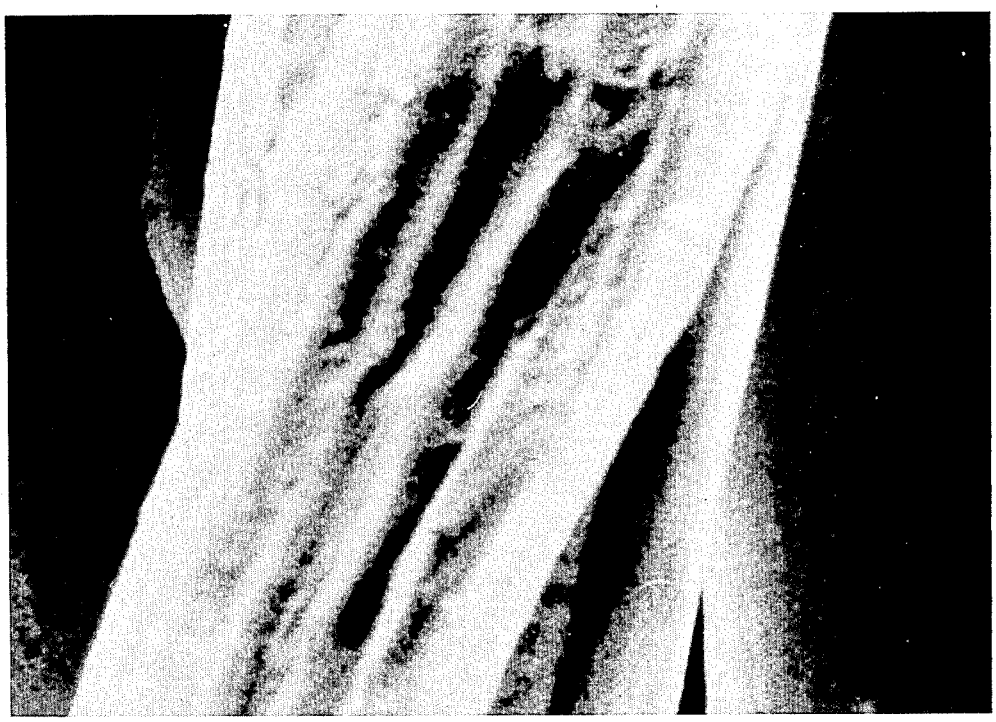
Figure 3:
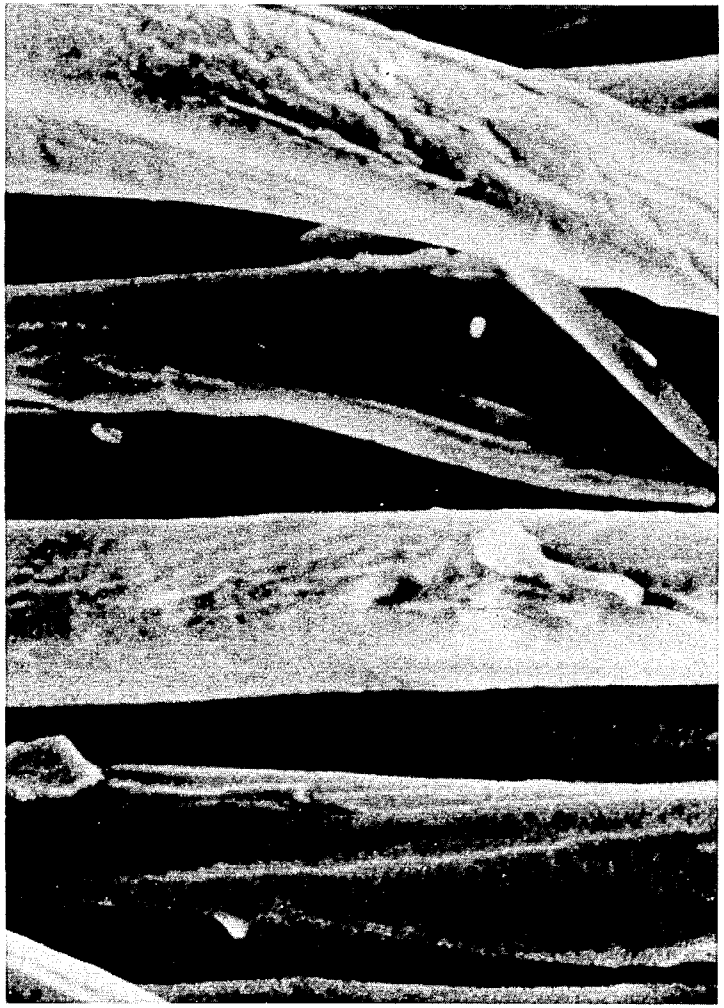

One example of the invention will be described hereinbelow. Five fibers of raw silk having an average of 21 denier were twisted at 160 turns per meter in a Z-direction and then scoured in a scouring agent including 10 weight % of Marsellies soap and 2 weight % of Monogen (trademark) at temperature of 92° C. to 96° C. for two hours. Thereafter, the scoured filaments remained as they are for one hour and were washed in water. Meanwhile, 20 cc of collagen derived protein for each to 1 kg of raw silk was dissolved in 1 liter of water to obtain a solution of collegan derived protein and the fibers were put in the solution for 10 to 20 minutes, after which they are dehydratedly dried to produce the raw material for producing silk yarn having curl shrinkage. The thus treated fibers were twisted at 2,500 turns per meter in a S-direction and taken up on a reel. The reel containing the twisted fibers was put in water for more than 2 hours to saturate the fibers with moisture. The moisture saturated fibers were maintained at temperature of 130° to 140° C. and under a pressure of 3 to 3.3 atmospheres for 15 to 20 minutes. Thereafter, the fibers were untwisted at 2,340 turns per meter in a Z-direction. The yarn thus produced was put in saturated vapor for 40 to 60 minutes to produce a curl shrink silk yarn. It will be noted from FIGS. 1 to 3 that this curl shrink silk yarn has the fibroin of the silk fixed at its twisting.

The following table shows the result of testing in curl shrinkage of the yarn produced in the afore-mentioned manner.

| | twist | | additional twist | | untwist | | curl | shrinkage | |
|---|---|---|---|---|---|---|---|---|---|
| number of filaments | direction | number of turns | direction | number of turns | direction | number of turns | rate of shrinkage | rate of recovery | rate of shrinkage in boiled water |
| 5 | Z | 160 | S | 2500 | Z | 2360 | 24.2 | 23.0 | 3.1 |
| 8 | Z | 160 | S | 2500 | Z | 2360 | 25.1 | 23.6 | 3.4 |

As noted from the table, the characteristics of curl shrinkage of the yarn has been improved. It should be noted that the temperature and the pressure in this invention may be lower than in the prior arts and therefore, the strength and durability of the fibers have been improved.

Although one embodiment of the invention has been illustrated and described with reference to the accompanying drawing, it should be understood that it is by way of example and that various modifications may be made without departing from the spirit and scope of the invention, which is intended to be defined only to the appended claims.

What is claimed:

1. A process for producing a curl shrunk silk yarn, comprising the sequential steps of (a) removing sericin from raw silk material, (b) absorbing collagen derived protein into said raw silk material, (c) twisting the silk fibers, (d) saturating the fibers with water, (e) maintaining said water saturated silk fibers at temperature of 130° to 140° C. and under a pressure of 3 to 3.5 atmospheres for 10 to 20 minutes, (f) untwisting said silk fibers in the reverse direction and (g) treating said silk fibers in saturated water vapor whereby said silk fibers are provided with a uniform curl shrinkage.

2. A curl shrunk silk yarn produced in accordance with the process of claim 1.

* * * * *